US005775004A

United States Patent [19]

Steier et al.

[11] Patent Number: 5,775,004

[45] Date of Patent: Jul. 7, 1998

[54] PROCESS AND APPARATUS FOR DRYING A SOLID-LIQUID MIXTURE

[75] Inventors: Klaus Steier, Munich; Stephan Wild, Quirnbach, both of Germany; Erwin Brunnmair, Graz, Austria

[73] Assignee: Andritz-Patentverwaltungs-Gesellschaft m.b.H., Graz, Austria

[21] Appl. No.: 710,930

[22] Filed: Sep. 24, 1996

[30] Foreign Application Priority Data

Sep. 27, 1995 [AT] Austria ..... 1598/95

[51] Int. Cl.[6] ..... F26B 7/00

[52] U.S. Cl. ..... 34/424; 34/498

[58] Field of Search ..... 34/359, 369, 371, 34/373, 379, 38, 386, 424, 498, 524, 575, 591, 550, 560, 566, 571, 579, 86, 132, 134, 139; 110/221; 210/770; 432/14, 58

[56] References Cited

U.S. PATENT DOCUMENTS

| | | | |
|---|---|---|---|
| 3,958,920 | 5/1976 | Anderson | 432/23 |
| 4,696,115 | 9/1987 | Spadafora | 34/524 |
| 4,713,893 | 12/1987 | Webb | 34/485 |
| 4,984,374 | 1/1991 | Bird et al. | 34/557 |
| 5,067,254 | 11/1991 | Linkletter et al. | 34/137 |
| 5,069,801 | 12/1991 | Girovich | 210/770 |
| 5,474,686 | 12/1995 | Barr | 210/771 |
| 5,588,222 | 12/1996 | Thompson | 34/379 |

FOREIGN PATENT DOCUMENTS 9324800 12/1993 WIPO .

*Primary Examiner*—Henry A. Bennett
*Assistant Examiner*—Steve Gravini
*Attorney, Agent, or Firm*—Roylance, Abrams, Berdo & Goodman, L.L.P.

[57] ABSTRACT

A process and an apparatus is disclosed for drying sludge or other materials, more specifically, sewage sludge, in which a mixture of base material and wet material is introduced to a drier and passing hot gas or hot air passed over the mixture. The process and apparatus by regulating the feed rate of the wet material (wet sludge) in relation to the exit temperature of the hot gas or hot air from the drier. In embodiments, the feed rate of material is adjusted to maintain a substantially constant temperature of the gas.

26 Claims, 2 Drawing Sheets

PROCESS AND APPARATUS FOR DRYING A SOLID-LIQUID MIXTURE

FIELD OF THE INVENTION

The present invention relates to a process and apparatus for drying sludge, more particularly, sewage sludge, in which a mixture of a base material and wet material is fed to a drier where hot gas or hot air is passed over the mixture. The present invention is particularly directed to a process and apparatus for controlling the feed rate of the material being dried to maintain a continuous output of dried material and substantially constant rate of drying.

BACKGROUND OF THE INVENTION

Various processes and apparatus are known for drying municipal sludge. The apparatus commonly used include drum driers, filter screens and filter belts. Many of these processes and apparatus force heated air or other heated gases over the material to be dried.

Examples of prior drying processes and apparatus are disclosed in U.S. Pat. No. 5,069,801 to Girovich and WO 93/24800. These apparatus include a drying device wherein heated gas is passed over the material to be dried. The temperature of the hot gases entering the drier is typically adjusted as it enters the drier in relation to the dry content level of the feed of wet sludge to the drier. As the dry content of the feed increases (i.e., a lower liquid content), the temperature of the hot gases is reduced to maintain a constant solid-liquid level of the material exiting the drier. This, however, results in a reduction of the drying efficiency when the temperature must be lowered. When wetter sludge is introduced, the feed rate or temperature of the hot gases must be increased. The upper limit of the temperature of the gases is limited by a heater or furnace. When the upper limit of the heater is obtained, proper drying of the material can only be achieved by reducing the throughput of the feed material being dried. Adjusting the feed rate of the material is often carried out manually.

The above-noted drying processes and apparatus, although generally effective, result in an inconsistent rate of drying. Accordingly, there is a continuing need in the industry for a process and apparatus to more efficiently control the drying of solid-liquid mixtures.

SUMMARY OF THE INVENTION

A primary object of the present invention is to provide a process and apparatus for controlling the feed of a solid-liquid mixture into a drying apparatus to maintain a constant rate of drying through the drying apparatus.

A further object of the invention is to provide a process and apparatus for regulating the feed of a solid-liquid mixture into a drying device in response to the exit temperature of drying gases exiting the drying apparatus to maintain a feed temperature and exit temperature of the drying gases at substantially constant temperatures.

A further object of the invention is to provide a process and apparatus for regulating an amount of a predried base material being fed to a drying device in relation to the entry temperature of the drying gases to the drier to adjust the system to a desired heating efficiency of the drier.

A further object of the invention is to provide a process and apparatus for controlling the feed rate of wet material, such as sludge, into the drying device by adjusting the speed of a feed device such as, for example, a feed screw to provide a simple and inexpensive means of efficiently adjusting the feed rate.

Another object of the invention is to provide a process and apparatus for regulating the quantity of base material fed into the drying device by adjusting the speed of the feeding device of the base material, such as, for example, the feed screw, to provide a simple and inexpensive means of efficiently adjusting the base material feed rate according to the drier conditions.

A further object of the invention is to provide a drying process and apparatus for mixing exhaust air from a furnace with recirculated air from a drier and introducing the mixture into the drying device for drying solid-liquid materials.

A further object of the invention is to provide a process and apparatus for circulating air heated in a heat exchanger which is heated by furnace exhaust.

Another object of the invention is to provide a process and apparatus for regulating the drying efficiency in a rotary drum drier, fluidized bed or disc drier.

The objects of the invention are basically attained by providing a process for drying a mixture of a substantially dry base material and a wet material comprising the steps of: feeding the base material and wet material to an inlet of a drying apparatus, feeding a hot gaseous material to an upstream end of the drying apparatus, for drying the mixture of base material and wet material, detecting the temperature of the gaseous material at an outlet of the drying apparatus, and adjusting the feed rate of the wet material into the drying apparatus in relation to the exit temperature of the gaseous material.

The objects of the invention are further attained by providing a process for drying solid-liquid mixtures comprising the steps of: feeding a solid-liquid mixture into a drying apparatus; feeding a hot drying gas to the drying apparatus for drying the solid-liquid mixture; detecting the temperature of drying gas exiting the drying apparatus after passing over the solid-liquid mixture; and adjusting the feed rate of the solid-liquid mixture in relation to the drying gas exit temperature.

The objects of the invention are also attained by providing an apparatus for drying a solid-liquid mixture, the apparatus comprising: a drying chamber having an inlet for receiving the solid-liquid mixture, an outlet for discharging a dried material, a gas inlet for receiving a hot drying gas for drying the solid-liquid mixture and a gas outlet for exhausting the drying gas; a feed device for feeding the solid-liquid mixture to the drying chamber; at least one temperature detector located at the gas outlet; and a regulating device for regulating the feed rate of the feed device in relation to a detected temperature of drying gas at the gas outlet.

Other objects, advantages and salient features of the invention will become apparent from the following detailed description, which, taken in conjunction with the annexed drawings, discloses several embodiments of the invention.

BRIEF DESCRIPTION OF THE DRAWINGS

Referring to the drawings which form part of this original disclosure.

DETAILED DESCRIPTION OF THE INVENTION

The present invention is directed to a process and apparatus for controlling and regulating the drying of a solid-liquid mixture. In preferred embodiments of the invention, a drier apparatus is fed with a solid-liquid mixture to be dried and a hot gaseous material for drying the mixture. In embodiments of the invention, the hot drying gaseous material feed is maintained at a substantially constant temperature. The temperature of the drying gases exiting the drier is measured by a temperature probe at the gas outlet. The temperature probe is in turn connected to a feed device for the solid-liquid mixture and adjusts the feed rate of the solid-liquid mixture to the drier in relation to changes in the exit temperature of the drying gases. The feed rate of the solid-liquid mixture is preferably adjusted to compensate for changes in moisture content of the solid-liquid mixture and to maintain the exiting drying gases at a substantially constant temperature. In this manner, the rate of drying remains relatively constant.

The process and apparatus of the invention can be used in connection with drying essentially any solid-liquid mixture. The process and apparatus are particularly suitable for use in drying municipal sludge. The solid-liquid mixture can, in embodiments of the invention, be a mixture of a previously dried material, referred to hereinafter as a base material, and a wet material to be dried. The base material in embodiments of the invention can be recycled material from the drier.

In one embodiment of the invention, the ratio of the previously dried material to the wet material to be dried is selectively adjusted in relation to the temperature of drying gases which are discharged from the drier. By adjusting this ratio, the liquid content of the feed mixture to the drier can be maintained at a reasonably constant level which maintains a constant rate of drying. In the preferred embodiments, the feed rate of the wet mixture is adjusted in response to the detected temperature of the drying gases exiting the drier while the feed rate of the previously dried material can be maintained at a constant level.

The drier is preferably fed with a hot gaseous material for drying the mixture. Typically, the hot gaseous material is heated air, hot exhaust gases from a furnace or other suitable drying gases.

Figure 1:
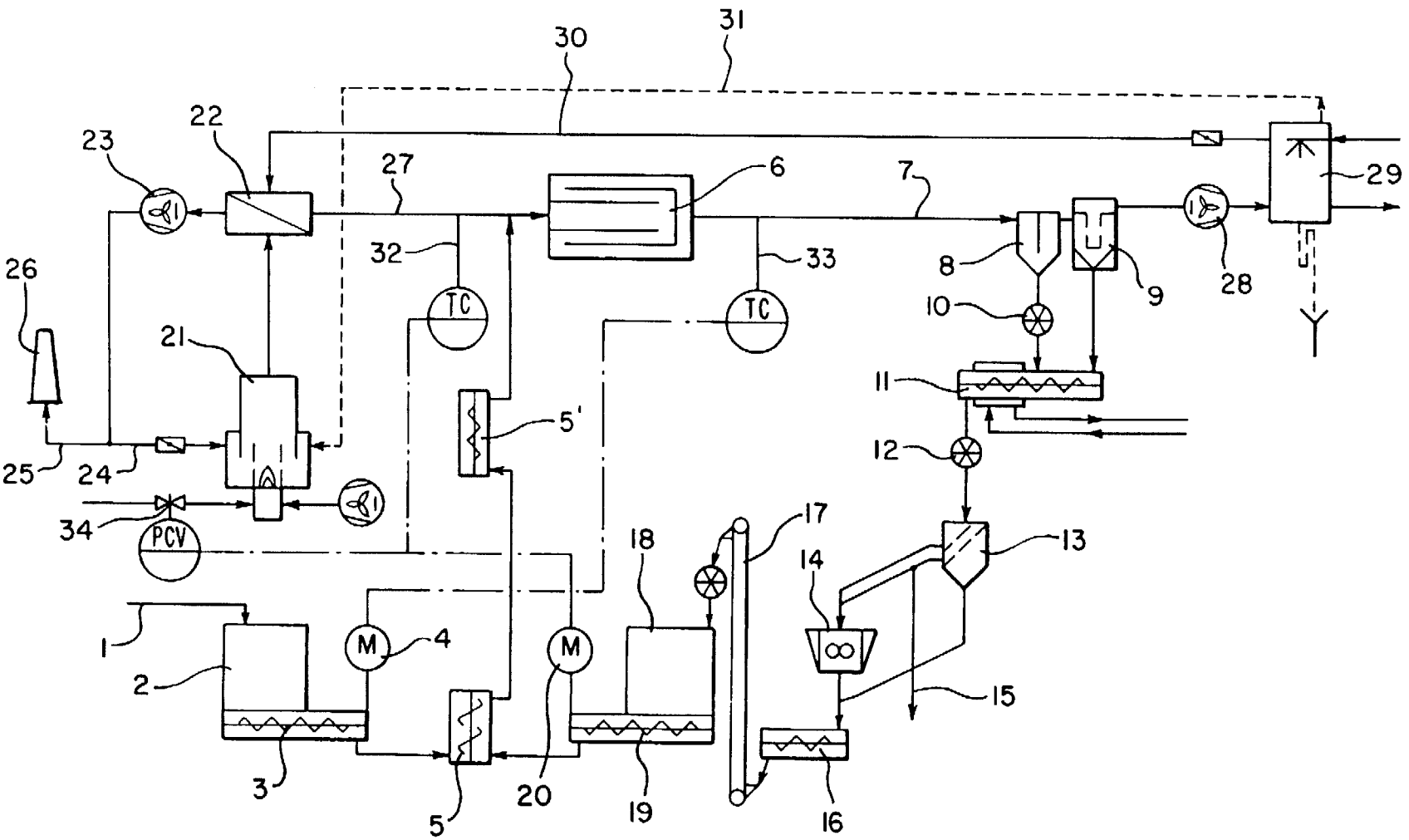
FIG. 1 is a schematic diagram of a solid-liquid mixture drying plant according to one embodiment of the invention.

Embodiment of FIG. 1

Referring to FIG. 1 which shows a first embodiment of the invention, predewatered sludge 1 is fed to a tank 2 where it is conveyed by a first feed screw 3, which is driven by an adjustable speed motor 4, to a mixer 5. The mixed sludge in mixer 5 is then conveyed by a second mixing and conveying screw 5' to an inlet at an upstream end of a drier 6. The drier 6 used can either be a triple-pass, rotary drum dryer, as shown, or a fluidized bed or disc drier. The material passes through the drier 6 and the dried material exits a discharge outlet at the downstream end of the drier 6 and is conveyed through a duct 7 to a separator or cyclone 8. Conveyed by the flow of drying air introduced to and exhausted from the drier 6, the material is passed through a rotary vane valve 10 to a screw conveyor 11. The fine solids particles that are left in the air after the cyclone 8 are separated from the air in a subsequent filter 9. The fines collected on filter 9 are also fed to the screw conveyor 11.

According to the schematic diagram of FIG. 1, the heat energy for the drying process is generated by a furnace 21 which transfers heat to the circulating air using a heat exchanger 22. A fan 23 recycles a portion of the exhaust gas from the furnace 21 back to the furnace 21 through duct 24 and the remainder through duct 25 to the exhaust stack 26 and from there into the environment. The circulating air heated in the heat exchanger 22 is directed to the drier 6 through duct 27.

The drying air in the apparatus is conveyed by a fan 28 situated downstream of the drier 6 and filter 9. This guarantees that the pressure in the drier and the drying air which conveys the material to be dried is below atmospheric pressure and, thus, that no dust can escape into the atmosphere. The hot, wet air exiting the drier 6 at the downstream end is blown by the fan 28 to a scrubber/condenser 29, where it is sprayed with cooling water. After being cooled and dried in this way, the air is then conveyed through a duct 30 to the heat exchanger 22 again and, thus, reutilized. A portion of the air from the scrubber 29 is taken through duct 31 to the furnace for incineration.

The solids granules formed in the conveyor 11 are then conveyed through a sluice 12 to a screening device 13, which separates and sends the oversized particles to a grinding mill 14. The granules with the specified size are conveyed through a duct 15 and discharged to packing and transport equipment (not shown). optionally, some of the specified-size granules can also be fed to the grinding mill 14.

The material crushed in the grinding mill 14 is mixed with the finest particles from the screening device 13 and then brought to a base material silo 18 via a screw conveyor 16 and an adjacent elevator 17. From this silo 18 a base material is fed to the mixer 5 by a base material feed screw 19 which is driven by a speed-controlled motor 20.

The entry temperature of hot air being fed to the drier 6 in duct 27 is measured by a temperature probe 32 and the drying air exit temperature is measured in duct 7 by a temperature probe 33. Temperature probe 33 is connected to the adjustable speed motor 4 to adjust the feed rate of the material to be dried in relation to the drying air exit temperature as discussed hereinafter in greater detail. The temperature probes 32, 33 include a control device capable of adjusting the speed of the motors 4, 20, respectively. To guarantee that the hot drying air supply to the drier 6 has the desired temperature, a signal from the temperature probe 32 is used to regulate the supply of fuel to the furnace 21 by means of a fuel valve 34. The temperature probe and control device can be commonly used components. The fuel used here can either be gas or oil.

When the dry content of the sludge or other material 1 being fed to the plant changes, the effect thereof can be measured downstream at the discharge outlet of the drier 6 in the exit temperature from the drier as measured by the probe 33. In the prior drying apparatus, the furnace temperature and air entry temperature to the drier, respectively, were regulated in relation to this exit temperature of drying gas. The result was that the air entry temperature had to be lowered if the sludge had a higher dry content, and this in turn caused a drop in the efficiency of the drier. If sludge with a lower dry content is introduced to the plant, the entry temperature to the drier must be raised, however the uppermost limit is reached here relatively quickly and the throughput of sludge to be dried must be reduced.

Since, according to the invention, the sludge or wet material feed is controlled in relation to the exit temperature of drying air from the drier 6, the entry temperature of the hot air to the drier can now be retained at a constant level. The temperature probe 33 detects changes in the gas exit temperature and adjusts the feed rate of the wet material accordingly to maintain a substantially constant gas exit temperature and a substantially constant gas feed temperature. If, at some point, sludge with a higher dry content is introduced (i.e., lower water content), the exit temperature from the drier will rise because less heat is required for evaporating moisture from the sludge. A signal to increase the throughput is then transmitted via the temperature probe 33 to increase the speed to the speed-controlled motor 4 of the feed screw 3. In this way, the amount of water in the material to be evaporated in the drier always remains the same. In the opposite case, if the dry content of the sludge introduced drops (i.e., water content increases), the temperature at the drier outlet will fall and a control signal is sent causing the motor 4 of the feed screw 3 to run slower, thereby lowering the feed rate of the sludge. In this way, it is also possible to maintain the amount of water to be evaporated at the same level.

To set the drier capacity, a suitable entry temperature of drying air can be preset for the drier. This may be required, for example, if the amount of wet sludge to be dried is small, and if energy consumption can be reduced at the furnace burner by reducing the drying temperature and the emissions contained in the exhaust air can be reduced. If the entry temperature to the drier is altered in this way, temperature probe 32 sends a signal to the motor 20 of the predried base material feed screw 19, with the amount of predried base material also being reduced to an appropriate level corresponding to the low entry temperature to the drier. Thus, the dry content in the mixture of wet sludge and predried base material fed to the drier is reduced, resulting in a lower exit temperature from the drier. The regulating temperature described above also reduces the quantity of sludge introduced, which in turn, creates a constant dry content in the sludge mixture fed to the drier 6. On the whole, the overall throughput of sludge going through the drier is reduced in this way.

The invention is not restricted to the embodiments described. On the contrary, it would be possible, for example, to use heated oil to heat the circulating air instead of the furnace, or to arrange the loop in a different order or include other plant components.

Figure 2:
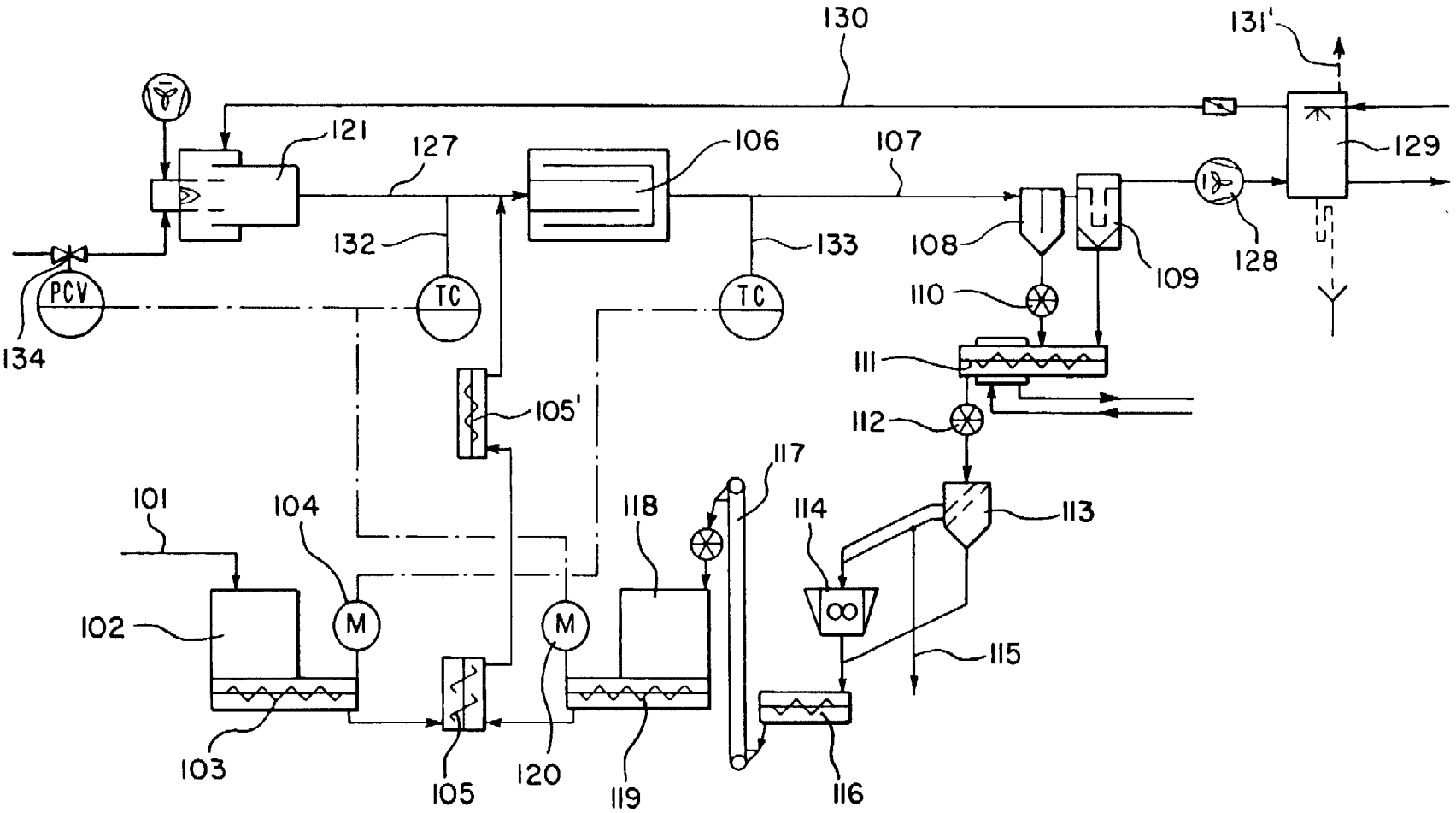
FIG. 2 is a schematic diagram of a solid-liquid mixture drying plant according to a second embodiment of the invention.

Embodiment of FIG. 2

FIG. 2 shows a sludge drying plant according to a second embodiment. In this embodiment, the apparatus is similar to the embodiment of FIG. 1, so like components are identified by the same reference number of the 100 series. In this embodiment, exhaust air from the furnace 121 is conveyed through a duct 127 directly to the drier 106. Here the circulating air 130 coming from the scrubber/condenser 129 is conveyed to the furnace 121 as combustion air. Excess wet air exits the scrubber/conveyor 129 through a duct 131' leading into the environment. In further-embodiments, filters are inserted where necessary before the excess air reaches the open air. The operation of the apparatus is substantially the same as in the embodiment of FIG. 1.

In the following, the invention will be explained with reference to examples of embodiments and to Table 1 provided below.

EXAMPLE 1

It is known to maintain the exit temperature from the drier at a constant level by controlling the entry temperature of the drying air. In the present example of the prior processes, wet sludge with a dry content of 25% is fed to a drier having a constant evaporating capacity. The pre-set air entry temperature to the drier is 450° C. and the exit temperature 90° C. If wet sludge with a high dry content is introduced to the drier, the amount of dry sludge will increase accordingly. Table 1 shows that, for example, the exit temperature from the drier will rise to 98° C. if the wet sludge has 27% dry content. By setting the entry temperature to 441° C., however, the desired exit temperature of 90° C. is obtained.

EXAMPLE 2

If wet sludge with a low dry content is fed to the sludge drying plant, at a dry content of 23%, it can be noted, for example, that the air exit temperature from the drier would be 79° C. By raising the air entry temperature to 462° C., an exit temperature of 90° C. is achieved once again. If the dry content of the wet sludge introduced is reduced further, the required entry temperature increases to 478° C., for example, at a dry content of 20%, and if the dry content is even lower, the high temperatures can no longer be reached. In this case, the sludge quantity fed to the drier must be reduced.

EXAMPLE 3

If wet sludge with a higher dry content, for example, 27%, is fed to a plant according to the invention, the throughput of wet sludge is increased so that the air temperature at the drier outlet always remains at a constant level as shown in Table 1. The wet sludge throughputs when compared with the figures of Example 1 to show a constant temperature of the drying air and an increase in fed rate of the wet material.

EXAMPLE 4

Similar to Example 3, the wet sludge introduced has a lower dry content and the throughput of wet sludge is reduced as shown in Table 1. Here the wet sludge throughputs when compared with the figures of Example 2 to show constant temperature of the drying air and a reduction of the wet material feed rate.

EXAMPLE 5

Where it is desirable to decrease the capacity of the drying plant because there is not a large amount of wet sludge available to be dried, the entry temperature of the air is reduced before it reaches the drier. Based on wet sludge with a constant dry content of 25%, a temperature of 400° C., for example, is preset as shown in Table 1. In order to obtain the same inlet conditions at the drier, the quantity of back-feed sludge or base material is reduced by regulating the feed screw. By reducing the amount of back-feed sludge in this way, the flow of sludge to the drier becomes wetter, causing the exit temperature from the drier to fall, as illustrated in Example 2. Consequently, the wet sludge feed is also reduced accordingly as a result of the feed screw being regulated, so that the desired constant exist temperature from the drier of 90° C. is achieved again for the given entry temperature to the drier. Fluctuations in the dry content of the wet sludge introduced are compensated in the same ways as described in Examples 3 and 4, with only the entry temperature to the drier and, thus, the input of back-feed sludge being reduced.

TABLE 1

| Wet sludge | | back feed | air temperature | | | |
|---|---|---|---|---|---|---|
| Dry content % | Quantity kg DS/h | sludge Quantity kg DS/h | Entry nom. °C. | Entry, regulated °C. | Exit, regulated °C. | Exit, not regulated °C. |
| Example 1 | | | | | | |
| 25 | 343 | 1872 | 450 | 450 | 90 | 90 |
| 27 | 371 | 1872 | 450 | 441 | 90 | 98 |
| 30 | 412 | 1872 | 450 | 428 | 90 | 113 |
| 35 | 481 | 1872 | 450 | 403 | 90 | 140 |
| Example 2 | | | | | | |
| 23 | 316 | 1872 | 450 | 462 | 90 | 79 |
| 20 | 275 | 1872 | 450 | 478 | 90 | |
| 15 | 206 | 1872 | 450 | | 90 | |
| Example 3 | | | | | | |
| 25 | 343 | 1872 | 450 | | 90 | |
| 27 | 382 | 1872 | 450 | | 90 | |
| 30 | 445 | 1872 | 450 | | 90 | |
| 35 | 565 | 1872 | 450 | | 90 | |
| Example 4 | | | | | | |
| 23 | 307 | 1872 | 450 | | 90 | |
| 20 | 256 | 1872 | 450 | | 90 | |
| 15 | 179 | 1872 | 450 | | 90 | |
| Example 5 | | | | | | |
| 25 | 343 | 1872 | 450 | | 90 | |
| 25 | 288 | 1858 | 400 | | 90 | |
| 25 | 239 | 1544 | 350 | | 90 | |
| 25 | 142 | 915 | 300 | | 90 | |

While specific embodiments of the invention have been disclosed herein, it is to be recognized by one skilled in the art that various modifications can be made to the system without departing from the spirit and scope of the invention as recited in the following claims.

What is claimed is:

1. A process for drying a mixture of a substantially dry base material and a wet material comprising the steps of:

feeding said dry base material and wet material to a mixer to form the mixture and feeding the mixture to an inlet of a drying apparatus, feeding a hot gaseous material to an upstream end of said drying apparatus, for drying said mixture of dry base material and wet material and producing a dried material, detecting the temperature of said gaseous material at an outlet of said drying apparatus, adjusting a feed rate of said wet material into said mixer in relation to the exit temperature of said gaseous material, and discharging said dried material from said drying apparatus.

2. The process according to claim 1, further comprising the step of regulating the base material feed rate in relation to the feed temperature of said gaseous material to said drying apparatus.

3. The process according to claim 1, further comprising the step of regulating the wet material feed rate by regulating the speed of a wet material feed device to maintain a substantially constant temperature of said gaseous material at said outlet.

4. The process according to claim 3, wherein said wet material feed device is a screw conveyor.

5. The process according to claim 2, further comprising the step of regulating the base material feed rate by regulating the speed of a base material feed device.

6. The process according to claim 5, wherein said base material feed device is a screw conveyor.

7. The process according to claim 1, further comprising the step of feeding exhaust gas from a furnace to said drying apparatus as a source of hot gaseous material.

8. The process according to claim 1, further comprising the step of withdrawing gaseous material from a downstream end of said drying apparatus and recirculating said gaseous material to the feed of said drying apparatus.

9. The process according to claim 8, further comprising heating said recirculated gaseous material in a heat exchanger prior to feeding to said drying apparatus.

10. The process according to claim 9, further comprising heating said recirculated gaseous material by exhaust air from a furnace.

11. The process according to claim 10, wherein said furnace is an oil fired furnace.

12. The process according to claim 1, comprising the step of feeding the mixture to a drying apparatus selected from the group consisting of a rotary drum drier, a fluidized bed drier, and a disc drier.

13. A process for drying solid-liquid mixtures comprising the steps of:

feeding a previously dried base material from a first silo and feeding a wet material from a second silo to a mixer to form a solid-liquid mixture;

feeding the solid-liquid mixture into a drying apparatus;

feeding a hot drying gas to said drying apparatus for drying said solid-liquid mixture;

detecting the temperature of drying gas exiting said drying apparatus after passing over said solid-liquid mixture;

adjusting the feed rate of said solid-liquid mixture in relation to said drying gas exit temperature to maintain a substantially constant drying gas exit temperature, discharging dried material from said drying apparatus;

separating said dried material into an oversized fraction and an undersized base material fraction; and recycling said undersized fraction to said first silo for feeding to said mixer.

14. The process of claim 13, further comprising regulating the speed of a feed device for feeding said solid-liquid mixture to said drying apparatus in response to said drying gas exit temperature.

15. The process of claim 13, wherein said hot drying gas is exhaust gas from a furnace.

16. The process of claim 13, further comprising recycling said exiting drying gas to said feed for said hot drying gas.

17. The process of claim 16, further comprising heating said exiting drying gas from said drying apparatus prior to feeding to said drying apparatus.

18. The process of claim 13, comprising the step of feeding the solid-liquid mixture to a drying apparatus selected from the group consisting of rotary drum driers, disc driers, and fluidized bed driers.

19. The process of claim 13, wherein said hot drying gas is heated air.

20. The process of claim 1, comprising screening the dried material discharged from a discharge outlet of said drying apparatus and separating a dried undersized base material, conveying the dried undersized base material to a storage silo, and feeding the dried undersized base material to said mixer.

21. The process of claim 20, further comprising feeding the dried undersized base material to said mixer at a feed rate in relation to the temperature of said gaseous material.

22. The process of claim 20, further comprising measuring the temperature of said gaseous material at an inlet of said drier and adjusting the feed rate of the dried undersized base material to said mixer in relation to the measured temperature at the inlet.

23. The process of claim 13, further comprising the step of feeding the dried base material to the mixer at a rate in relation to a temperature of the gaseous material.

24. The process of claim 13, further comprising the steps of measuring a feed temperature of the gaseous material to the drier, and adjusting the feed rate of the dried base material to the mixer for adjusting the liquid content of the mixture in relation to the feed temperature of the gaseous material.

25. The process of claim 1, wherein said gaseous material and dried material exit said drying apparatus through a discharge outlet of said drying apparatus.

26. The process of claim 13, wherein said drying apparatus includes a discharge outlet for said drying gas and dried material at a downstream end, and wherein said process comprises detecting the temperature of said drying gas at said discharge outlet.

* * * * *